United States Patent [19]

Kodama et al.

[11] Patent Number: 4,877,149

[45] Date of Patent: Oct. 31, 1989

[54] SCORED CONTAINER TOP

[75] Inventors: Akinori Kodama; Takeshi Takahashi, both of Kanagawa, Japan

[73] Assignee: Showa Denko Kabushiki Kaisha, Tokyo, Japan

[21] Appl. No.: 278,529

[22] Filed: Nov. 30, 1988

[51] Int. Cl.[4] ..... B65D 17/30

[52] U.S. Cl. ..... 220/267; 220/270; 220/273

[58] Field of Search ..... 220/267, 269, 270, 271, 220/272, 273, 229 MF

[56] References Cited

U.S. PATENT DOCUMENTS 4,267,937 5/1981 Piltz et al. ..... 220/267
4,408,697 10/1983 Yoshikawa et al. ..... 220/267 X
4,616,766 10/1986 Miyauchi et al. ..... 220/450
4,674,649 6/1987 Pavely ..... 220/271
4,784,284 11/1988 Miyauchi et al. ..... 220/270

*Primary Examiner*—Stephen Marcus
*Assistant Examiner*—Nova Stucker
*Attorney, Agent, or Firm*—Sughrue, Mion, Zinn, Macpeak & Seas

[57] ABSTRACT

A circular "pop-top" can has a multilayer foil (19) and resin (20, 21) base 4, on the upper surface of which a rigid injection molded resin layer 5 is formed. An elliptical groove 6 surrounds a semicircular pedestal 8 extended inwardly by a U-shaped projection 9 having score lines 18 extending across its legs. The butt of a pull tab 12 is fixed to the pedestal such that upon lift up the tab and pedestal pivot downwardly about the score lines to rupture the exposed base at the groove.

3 Claims, 8 Drawing Sheets

SCORED CONTAINER TOP

BACKGROUND OF THE INVENTION

This invention relates to an easily openable top for a container such as a beverage can or a soup can.

A conventional can-like container mainly made of a synthetic resin is disclosed in Japanese Kokai No. 39489/77. Such containers need to meet a number of requirements to be put on the market. For example, the retorting property of the container, in the body of which a soft drink or the like is packed under retorting before the container and the contents thereof are distributed as a piece of merchandise, must be good, the container must not undergo separation, exfoliation or the like due to thermal hysteresis from the retorting or the like, the drop strength of the container must be high, the container must be hygienic for food and easy to form, the container must be capable of incineration, its gas-insulating properties must be high enough to preserve the contents for a relatively long time, and its ease of opening must be high.

SUMMARY OF THE INVENTION

Accordingly, it is an object of the present invention to provide a top for a can-like container mainly made of a synthetic resin and enhanced in its ease of opening.

The top of the invention is attached to the body of the container, and is characterized in that a resin layer is deposited, by injection molding, on one side of a multilayer base composed of a gas-insulating basic material and resin layers provided on both the sides of the material and capable of being fuse-bonded. The central portion of the top has a grooved part in which the multilayer base is exposed, and a projection located inside the grooved part and extending from a pedestal, to which the butt of a tab is conjoined, and is provided with scores extending perpendicularly to the direction of opening of the top.

Since the projection extending from the pedestal to which the butt of the tab is conjoined is provided with the scores, the cross section of each of which is V-shaped, for example, the projection is bent at the scores when the top is opened by pulling the tab, so that the end of the pedestal easily pierces the multilayer base. For that reason, it is easier to open the top by pulling the tab.

DETAILED DESCRIPTION OF THE PREFERRED EMBODIMENTS

Figure 3:
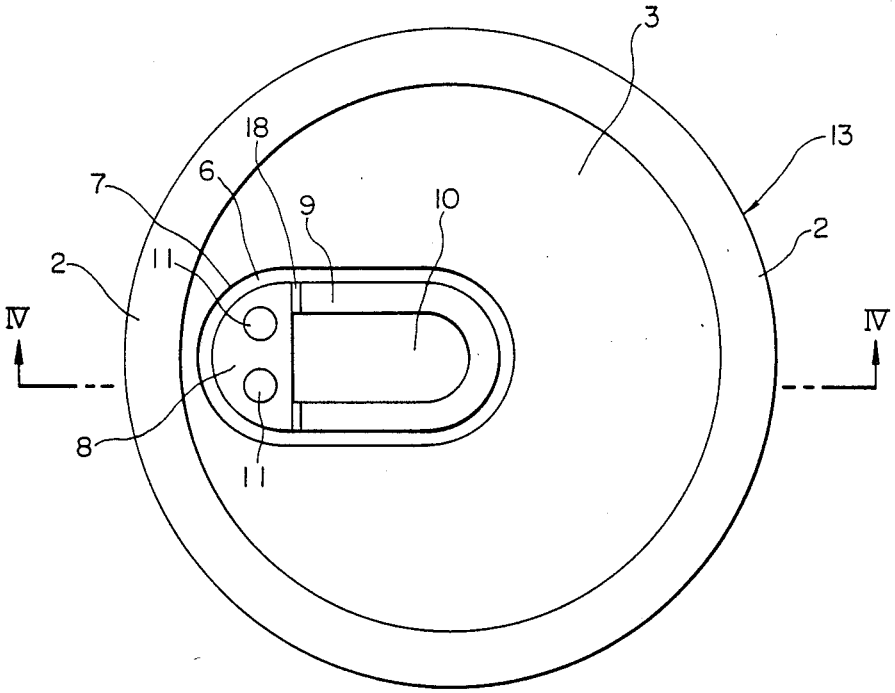
FIG. 3 shows another plan view of the top.
Figure 4:
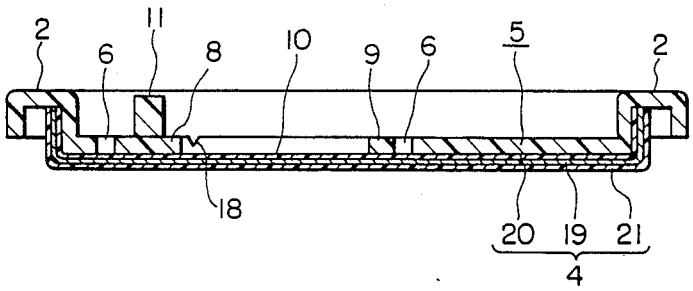
FIG. 4 shows a sectional view of the top along line IV—IV in FIG. 3.

With reference to the drawings, FIG. 3 shows a plan view of a container top 13, not yet being fitted with a tab. FIG. 4 shows a sectional view of the top along line IV—IV in FIG. 3. The top comprises a peripheral portion 2 and a central portion 3, and is made of a multilayer base 4 and an injection-molded resin layer 5 deposited thereon. The central portion 3 has a grooved part 6 made of only the multilayer base 4 so that the base is exposed in the grooved part. It is preferable that the whole grooved part 6 is curve shaped as shown in FIG. 3. In this embodiment, the grooved part 6 is shaped as an ellipse. The top can be opened along the outer circumferential edge 7 of the grooved part 6 as described hereinafter. A semicircular pedestal 8, to which the tab is attached, is provided inside the grooved part 6. A U-shaped projection 9 extends from the pedestal 8. A part 10 surrounded by the pedestal 8 and the projection 9 is made of only the multilayer base 4 so that the base is exposed in this part. However, the part 10 may be made of both the multilayer base 4 and the injection-molded resin layer 5 so that the base is coated with the layer. Two bosses 11 for fuse-bonding one end of the tab to the semicircular pedestal 8 are provided on the pedestal. However, only one boss may be provided on the pedestal 8.

Figure 5:
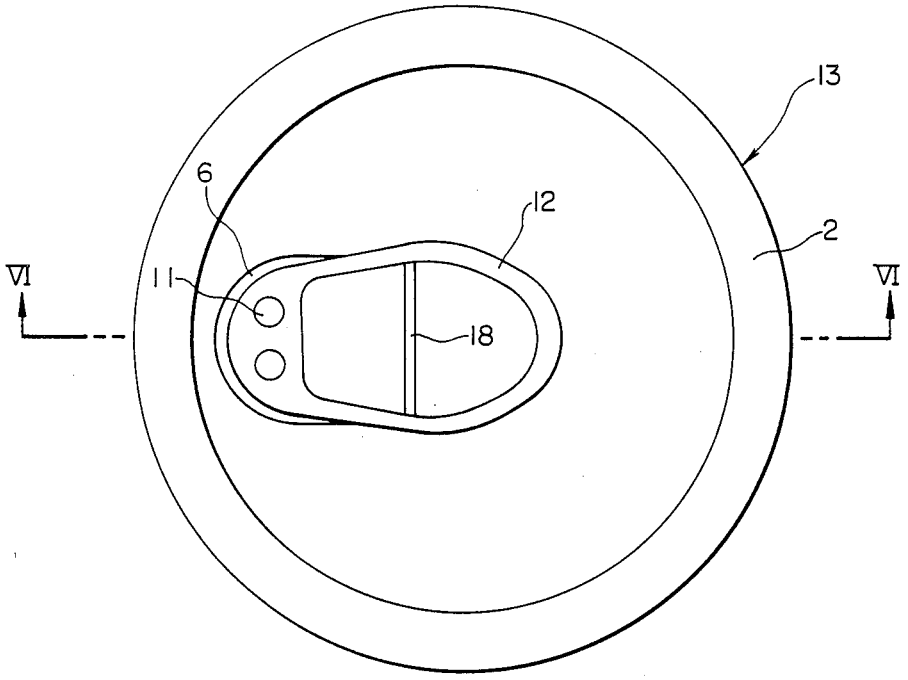
FIG. 5 shows a plan view of the assembled top.
Figure 6:
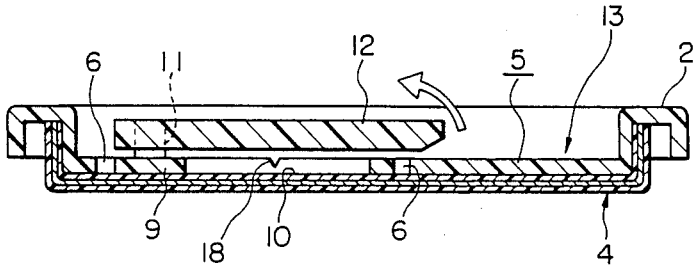
FIG. 6 shows a sectional view of the top along line VI—VI in FIG. 5.

FIG. 5 shows a plan view of the top 13 having a tab 12 attached, and FIG. 6 shows a sectional view of the top 13 along line VI—VI in FIG. 5. In order to attach the tab 12 to the bosses 11, the butt of the tab is provided with the same number of circular holes as the bosses, the bosses are then inserted upwardly through the holes to place the tops of the bosses over the holes and place the mutual contact surfaces of the semicircular projection 8 and the tab 12 under the holes, and the bosses are thereafter fused by ultrasonic waves to fill the holes with the fused bosses and conjoin the contact surfaces to each other. The circular holes in the butt of the tab 12 need not be through holes for inserting the bosses 11 through to place the tops of the bosses over the holes. The tab 12 made of a resin is thus attached to the top body 1.

Figure 7:
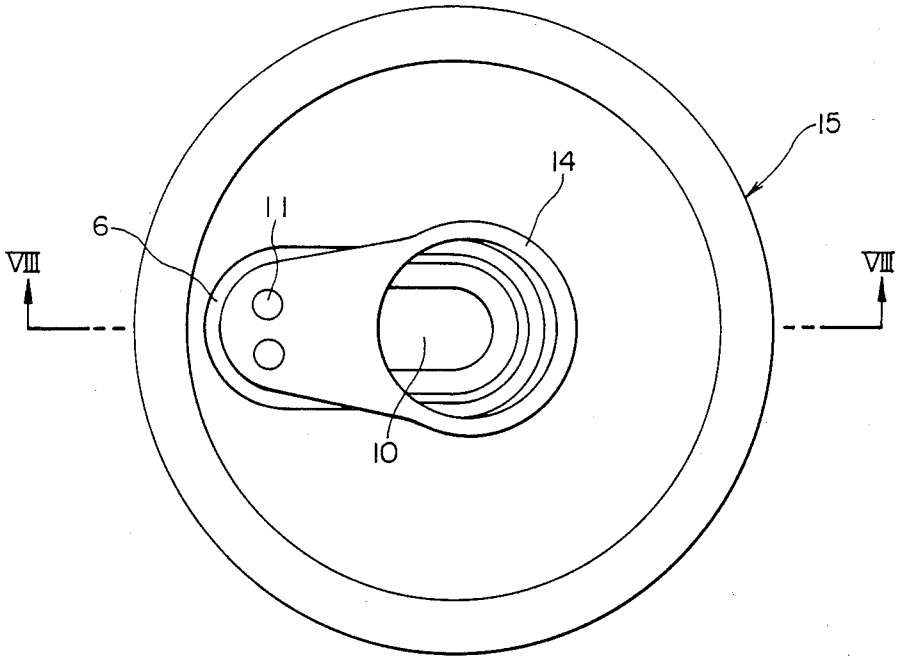
FIG. 7 shows a plan view of a modified top pull tab.
Figure 8:
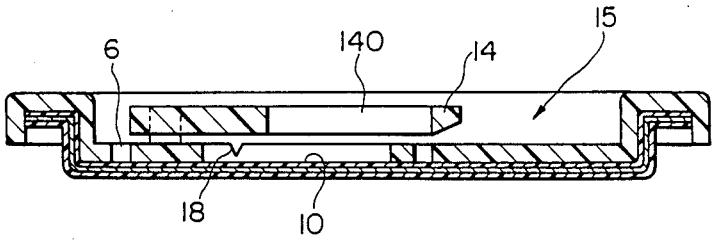
FIG. 8 shows a sectional view of the top along line VIII—VIII in FIG. 7.
Figure 9:
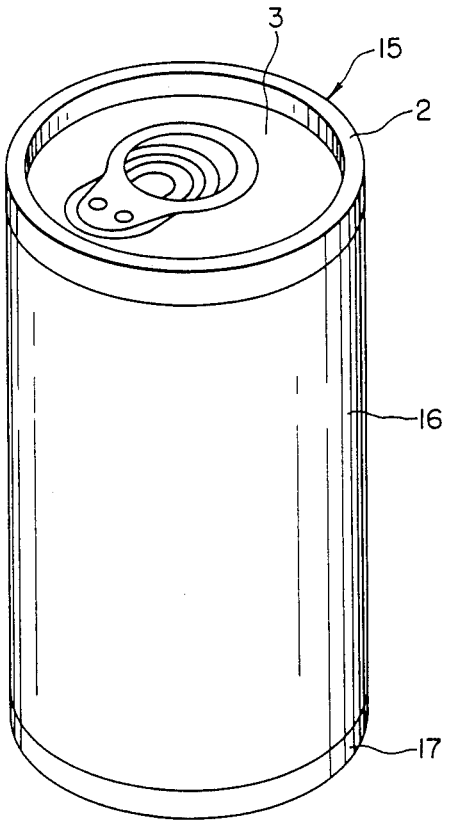
FIG. 9 shows a perspective view of a container having the top shown in FIG. 7.
Figure 10:
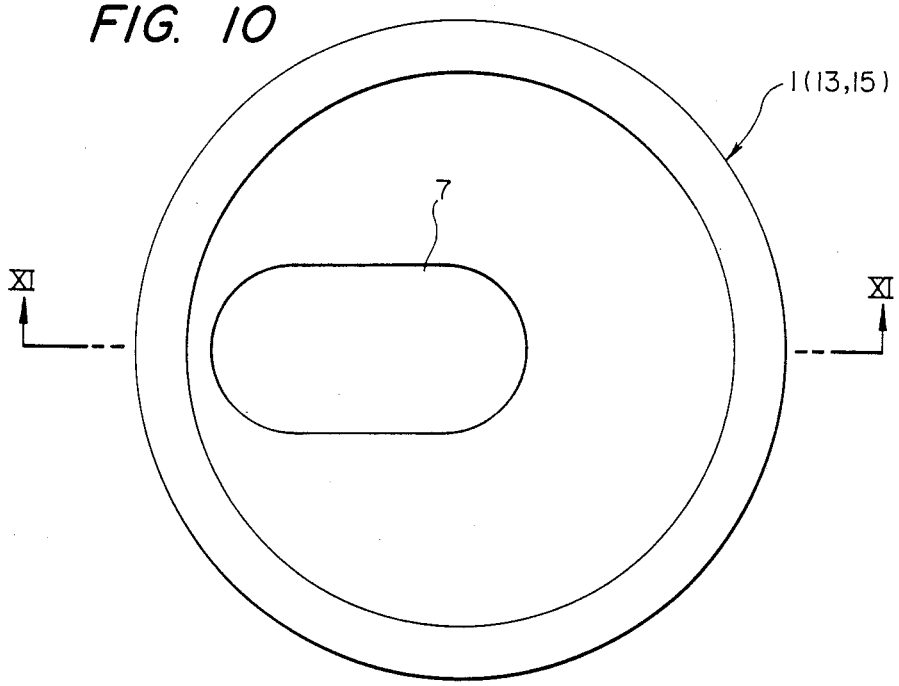
FIG. 10 shows a plan view of the opened top shown in FIGS. 5 or 7.
Figure 11:
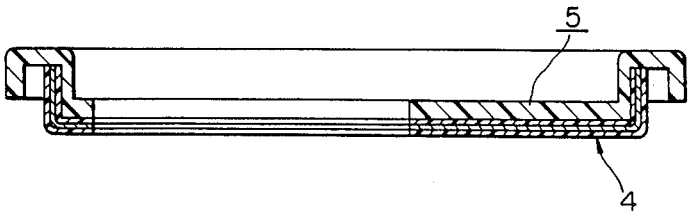
FIG. 11 shows a sectional view of the top along line XI—XI in FIG. 10, FIGS. 12, 13 and 14 show sectional views for describing a top manufacturing process.

FIG. 7 shows a plan view of a top 15 of another embodiment, wherein the tab 14 has a circular hole 140 through which a straw can be inserted into the container. FIG. 8 shows a sectional view of the top 15 along line VIII—VIII in FIG. 7. FIG. 9 shows a perspective view of a container which has the top 15 having its peripheral portion 2 attached to the body 16 of the container and a bottom 17 attached to the lower end of the container body. FIG. 10 shows a plan view of the top 15 opened, and FIG. 11 shows a sectional view of the top 15 along line XI—XI in FIG. 10.

To open each of the tops 13 and 15 the free end of the tab 12 (or 14) is first lifted as shown by an arrow in FIG. 6, so that the end of the semicircular pedestal 8 fitted with the butt of the tab pierces the multilayer base 4.

The tab 12 is then continuously pulled so that the top is opened along the outer circumferential edge 7 of the grooved part 6.

Figure 1:
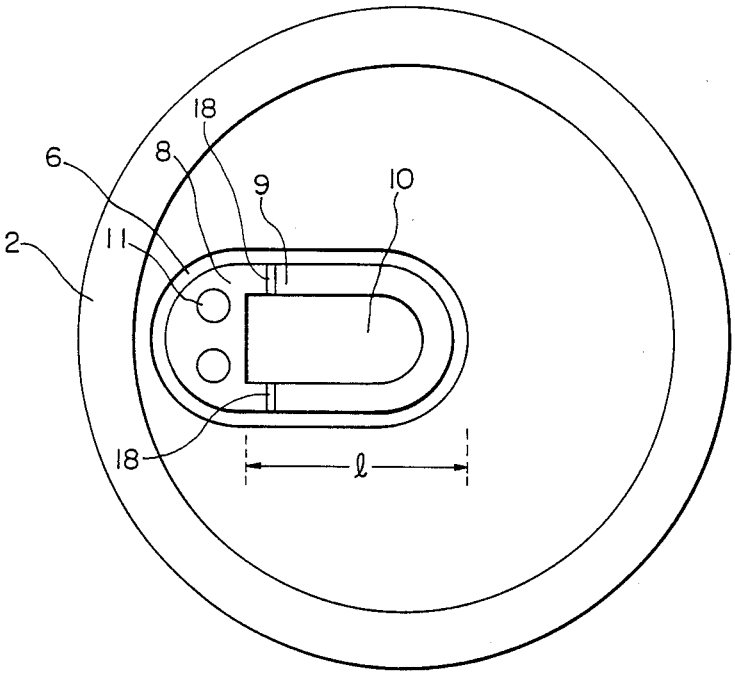
FIG. 1 shows a plan view of a can top in accordance with an embodiment of the invention.
Figure 2:
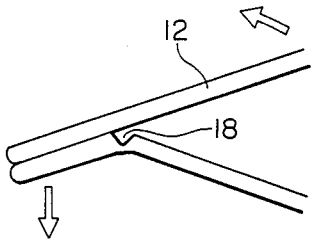
FIG. 2 shows a sectional view of a major portion of the top.

In each of the tops 13 and 15, the grooved part 6 divides the central portion 3 of the body 1 of the top into a section to be left on the top after opening, and another section to be removed. The grooved part is elliptically shaped and of appropriate width, and located as near the peripheral portion 2 of the to as possible, and the tab 12 or 14 is firmly conjoined to the bosses 11 by ultrasonic fuse-bonding. For that reason, the ease of opening of the tops 13 and 15 is enhanced. Further, the U-shaped projection 9 of each of the tops is provided with scores 18, as shown in FIGS. 1 and 2, so that the ease of opening is further enhanced. The scores 18 extend perpendicular to the direction of opening of the top. The cross section of each of the scores 18 is shaped as V, J, K, U or the like. It is preferable that the cross section of each score 18 is U-shaped. When the tab 12 or 14 is lifted to open the top 13 or 15, the projection 9 is bent at the scores 18 as shown in FIG. 2, to increase the pressure on the multilayer base 4 to make it easier to open. The scores 18 may either extend along only a part of the width of the projection 9, or extend across the total width of the projection. The distance between each score 18 and the boundary of the pedestal 8 and the projection 9 is less than half of the length l of the projection, to facilitate the opening of each of the tops 13 and 15 by increasing the tab leverage.

The multilayer base 4 of each of the tops comprises a gas-insulating basic material 19 and fusible resin layers 20 and 21 on both sides of the basic material. The basic material 19 prevents oxygen, moisture and the like from passing through it. The basic material 19 is a metal foil or a sheet or film of a saponification of an ethylene and vinyl acetate copolymer, a polyvinylidene chloride, a polyamide, a polyacrylonitrile or the like. In the embodiments, an aluminum foil is used as the basic material 19, for example. The thickness of the gas-insulating basic material 19 is set at 50μ or less, preferably at 9μ to 30μ, so that it is easy to open the multilayer base 4 and each top 13 or 15 has sufficient strength against deformation, rupture, breaking or the like in dropping, formation or the like. With such thickness, the basic material 19 can be completely incinerated with a low heat amount of 5,000 kcal/kg to 6,000 kcal/kg to avoid abandoning the container as litter.

Each of the tops 13 and 15 is attached to the body 16 of the container, which has a resin layer similar to the tops. The lower resin layer 20 of the multilayer base 4 is attached to the body 16 of the container. The upper resin layer 21 is fuse-bonded to the injection-molded resin layer 5 deposited on the base. For these reasons, it is preferable that the base 4 has the lower and the upper resin layers 20 and 21. Since the upper resin layer 21 is fuse-bonded to the resin layer 5, the base 4 is firmly conjoined to the injection-molded resin layer. However, the upper resin layer 21 does not necessarily need to be provided. The resin layers 20 and 21 are made of a fusible resin such as a thermoplastic synthetic resin; they may be either made of the same resin or made of mutually different resins. The resin layers 20 and 21 may be either conjoined to the gas-insulating basic material 19 directly, or via an interposed adhesive resin layer such as a liquid adhesive or a film-like fusible adhesive. The thickness of each of the resin layers 20 and 21 is set at 100μ or less so that it is easy to open each top.

Figure 10A:
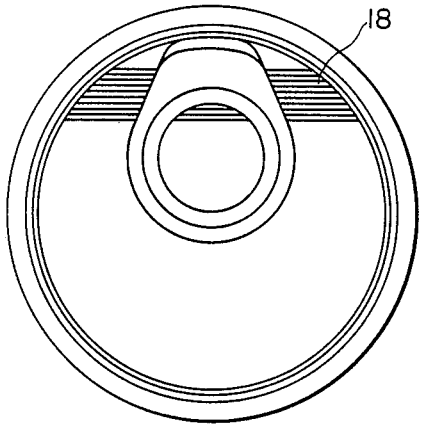
FIG. 10A shows a plan view of a fully openable top according to the invention.

FIG. 10A shows a fully openable type top with a plurality of scores 18 according to the invention.

Figure 12:
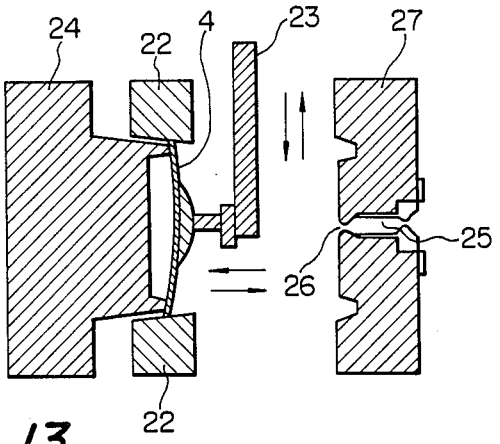
Figure 13:
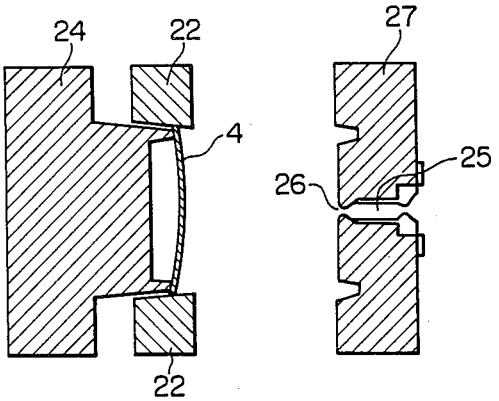
Figure 14:
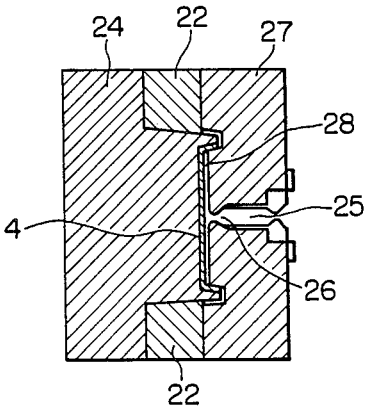

The manufacture of the tops 13 and 15 is sequentially shown in FIGS. 12, 13 and 14, wherein the multilayer base 4 is first placed in a guide 22 by a suction grip on the moving arm 23 of a robot. The base 4 is then held in the guide 22 as shown in FIG. 13, whereafter it is pressed as shown in FIG. 14 so that the nearly two-dimensional base is bent near its edges in a die 24. A molten resin is thereafter injected into a cavity 28 defined by the die 24 and another die 27, through the gate 26 of the die 27 having a resin inflow passage 25, so that the injection-molded resin layer 5 is formed on the surface of the multilayer base 4, and the bosses 11 are made on the semicircular pedestal 8 extending from the U-shaped projection 9. The grooved part 6 and the scores 18 are also made at the time of the injection molding of the resin. The tab 12 is made of the same resin separately from the injection molding of the resin layer 5, and thereafter attached to the bosses 11 by ultrasonic fuse-bonding.

In the conventional manufacture of such can tops, an aluminum foil coated with a fusible resin on both sides is bonded to a previously injection-molded resin sheet by an adhesive to form the top. This procedure has the drawbacks that the number of manufacturing steps is large which increases the cost of the top, the top undergoes separation, exfoliation or the like due to thermal hysteresis from retorting, the drop strength of the top is low, and the adhesive is undesirable for food hygienics.

The present inventors studied the manufacture of tops by injection molding instead of adhesive bonding. As a result, they found that a conventional procedure of injection molding, in which a nearly two-dimensional multilayer base is only set along the forms of dies, had a problem that the base is displaced to lower the accuracy of its positioning relative to an injection-molded resin layer. The inventors et al thereafter conceived the above-described procedure of injection molding in which the multilayer base 4 is placed in a guide 22 and held therein to solve the problem.

Figure 15:
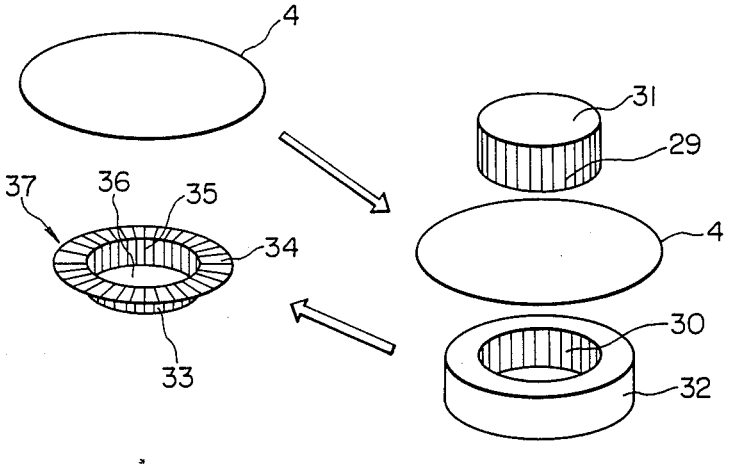
FIG. 15 shows an exploded perspective view for describing another top manufacturing process.
Figure 16:
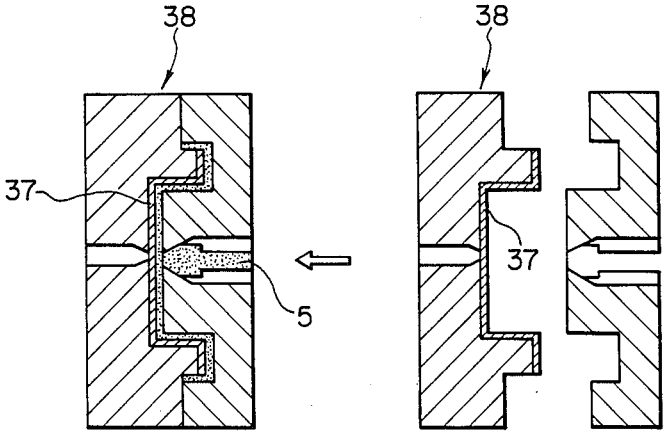
FIG. 16 shows a sectional view of the other top manufacturing process.

An alternate procedure is shown in FIGS. 15 and 16, wherein a disk-shaped multilayer base 4 is set between a punch 31 and a die 32 which have axial peripheral grooves 29 and 30, respectively. The punch 31 is then inserted into the internal opening of the die 32. At that time, the excess portion of the multilayer base 4, i.e. excess for the pushing area of the punch 31, as absorbed by wrinkles 33 so that the base is changed into a preformed base 37 having a flange 34, a wall 35 and a bottom 36 in an ashtray shape, substantially without extending or elongating the base 4. The flange 34 is formed by a flat plate (not shown) attached to the top of the punch 31. The preformed multilayer base 37 is then set in an injection molding die 38, and molten resin 5 is injected. The base 37 is pushed against the die 38 by the pressure of the injected resin 5, so that the wrinkles 33 are eliminated. In this way, irregular large wrinkles, which may be formed in the multilayer base 4 in the injection molding procedure described above with reference to FIGS. 12, 13 and 14, are prevented from being made. Improper seaming is thus prevented when the peripheral portion 2 of the top is fuse-bonded to the body 16 of the container by high-frequency induction heating. Besides, the gas-insulating basic material 19 of the multilayer base 4 is prevented from being cut off due to local heating. Since the multilayer base 37 is preformed without substantially being extended or elongated, an aluminum foil of small thickness can be used and the thickness of the foil is made uniform.

Various kinds of resins can be used as the injected resin 5, for example a polyolefinic synthetic resin such as a polypropylene and an ethylene and polypropylene copolymer, which has a high resistance against the high temperature of retorting.

The injected resin 5 may be mixed with an inorganic additive, which enhances the dimensional stability of the tops, and decreases their contraction ratio. The heat-resisting property of the tops is improved and their thermal conductivity and deformation temperature is heightened to facilitate retorting. The amount of heat necessary to incinerate each of the tops is also decreased to avoid damaging the incinerator. The tops are provided with sufficient rigidity for the commercial distribution of the product, and their cost is diminished. The inorganic additive may be those widely used for rubbers and synthetic resins. These additives are inorganic compounds which are hygienic for food and do not react with oxygen and/or water, nor decompose during mixing and molding. The additives can be broadly classified into metal oxides, metal hydrates or hydroxides, sulfates, carbonates, silicates, and complex salts and mixtures thereof. For example, the additives may be aluminum oxide (alumina), a hydrate thereof, potassium hydroxide, magnesium oxide (magnesia), magnesium hydroxide, zinc oxide (zinc flowers), lead oxide such as red lead and white lead, magnesium carbonate, potassium carbonate, basic magnesium carbonate, white carbon, asbestus, mica, talc, fiberglass, glass powder, glass beads, clay, diatomite, silica, iron oxide, antimony oxide, titanium oxide (titania), lithopone, pumice powder, aluminum sulfate (gypsum or the like), zirconium silicate, zirconium oxide, barium carbonate, dolomite, molybdenum bisulfide, and iron. If the inorganic additives are powdery, it is preferable that the diameter of each grain is 20μ or less, more preferably 10μ or less. If the additives are fibrous, it is preferable that the diameter of each fiber is 1μ to 500μ, more preferably 1μ to 300μ, and the length of the fiber is 0.1 mm to 6 mm, more preferably 0.1 mm to 5 mm. If the additives are flaky, it is preferable that the diameter of each flake is 30μ or less, more preferably 10μ or less. The flaky and the powdery additives are particularly preferable. Besides, the injected resin 5 may be mixed with additives such as pigments.

What is claimed is:

1. A top adapted to be attached to a body of a can-like container, comprising: a multilayer circular base (4) composed of a gas-insulating basic material (19) and resin layers (20, 21) provided on both the sides of said basic material and capable of being fuse-bonded, a resin layer (5) is deposited, by injection molding, on one side of said base, a central portion (3) of said top having a closed figure defined by a continuous groove (6) extending through said molded resin layer and down to said base, a projection (9) disposed inside said groove and extending from a pedestal (8), a butt of a pull tab (12, 14) joined to said pedestal, and scores (18) extending across the projection perpendicular to a direction of opening of said top.

2. A top according to claim 1, wherein the groove is elliptical, the pedestal is semi-circular, the projection is U-shaped, extends radially inwardly from the pedestal, and is coplanar therewith, and the scores extend across arms of the projection proximate the pedestal.

3. A top according to claim 2, wherein the pull tab is planar, and generally overlies the pedestal and the projection, and the butt of the pull tab is fixedly joined to a planar upper surface of the pedestal such that, upon forcedly raising a radially inner end of the tab, the joined butt and pedestal pivot downwardly about the scores to rupture the top at a radially outermost portion of the groove.

* * * * *